US005129445A

United States Patent [19]

Jacquot et al.

[11] Patent Number: 5,129,445

[45] Date of Patent: Jul. 14, 1992

[54] METHOD FOR STARTING THE CONTINUOUS CASTING OF MOLTEN METAL ON A ROLL

[75] Inventors: Jean-Luc Jacquot, Metz; Laurent Sosin, Fameck; Jean-Marie Osswald, Peltre, all of France

[73] Assignee: Usinor Sacilor, 4 Place de la Pyramide, Puteaux, France

[21] Appl. No.: 624,310

[22] Filed: Dec. 4, 1990

[30] Foreign Application Priority Data

Dec. 26, 1989 [FR] France ..... 8917194

[51] Int. Cl.[5] ..... B22D 11/00; B22D 11/08

[52] U.S. Cl. ..... 164/483; 164/463; 164/479

[58] Field of Search ..... 164/423, 427, 429, 438, 164/463, 479, 483, 488, 489

[56] References Cited

U.S. PATENT DOCUMENTS

| | | | |
|---|---|---|---|
| 3,338,295 | 8/1967 | Scribner | 164/479 |
| 3,522,836 | 8/1970 | King | 164/479 |
| 4,614,222 | 9/1986 | Maringer | 164/488 |
| 4,907,641 | 7/1990 | Gaspar | 164/429 |

FOREIGN PATENT DOCUMENTS

| | | | |
|---|---|---|---|
| 3627196A1 | 2/1987 | Fed. Rep. of Germany . | |
| 150648 | 8/1984 | Japan | 164/438 |

OTHER PUBLICATIONS

Patent Abstracts of Japan, vol. 12, No. 126; Apr. 19, 1988, Continuous Casting Apparatus, (JP-A-6-2-252645).

Patent Abstracts of Japan, vol. 11, No. 356; Nov. 20, 1987, Molten Metal Pouring Method in Manufacturing Rapid Cooled Foil Metal, (JP-A-62-134147).

*Primary Examiner*—Richard K. Seidel

*Attorney, Agent, or Firm*—Frishauf, Holtz, Goodman & Woodward

[57] ABSTRACT

The invention relates to a method for starting a device for the continuous casting of molten metal, particularly steel, on a cooled roll (1) rotating about its horizontal axis. An adjacent container (4) contains the metal to be cast and has a front wall (5) whose free upper edge (11) is lowered in order to permit the exit of the metal to be cast, and which is swept by the cooled surface of the roll (1). According to the invention, casting is started with a relatively large lead angle (A) and, when casting has started, the container is displaced by pivoting about a horizontal axis, which can be the axis of rotation of the roll, so as to reduce the lead angle in order to arrive at a nominal working position (4') in which the container is held stationary.

12 Claims, 1 Drawing Sheet

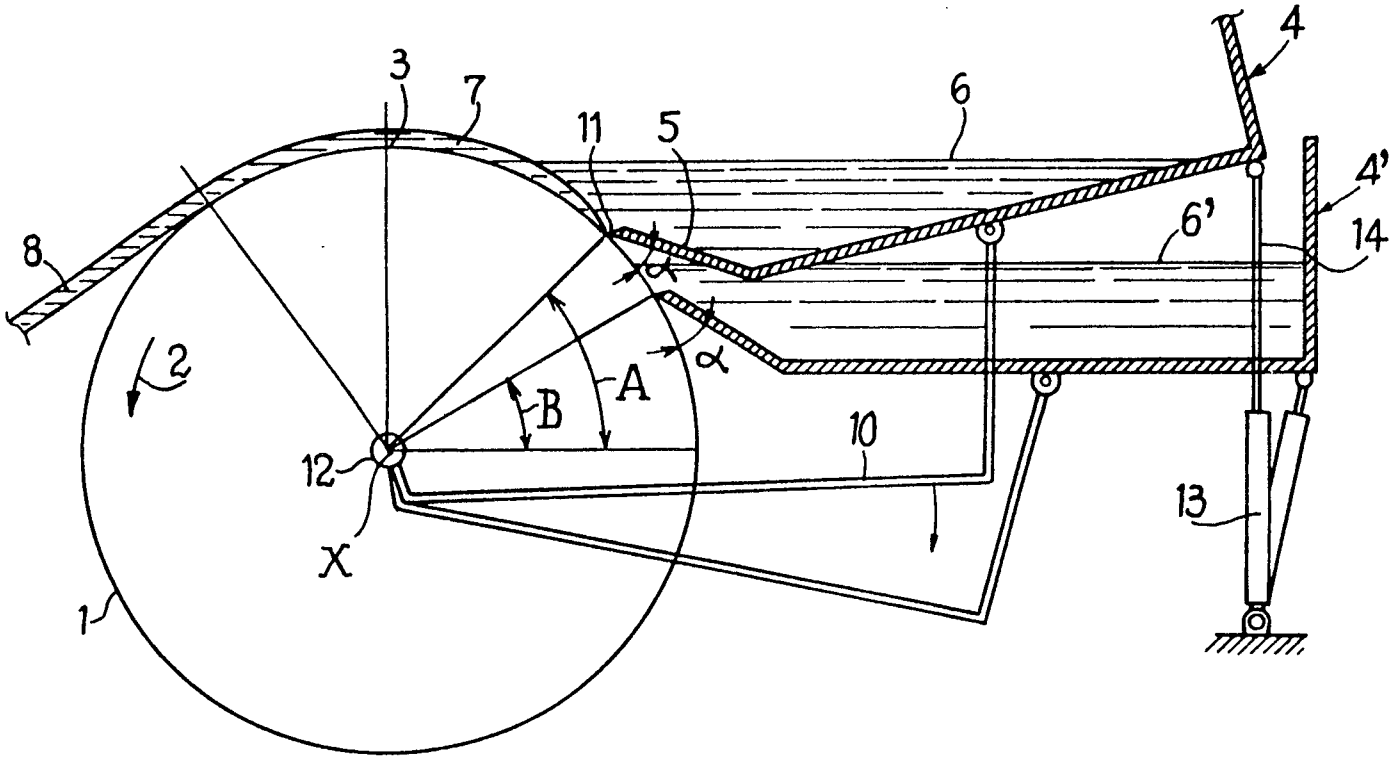
4
4'
14
6'
13
6
10
5
11
A
B
7
3
12
X
2
1
8

METHOD FOR STARTING THE CONTINUOUS CASTING OF MOLTEN METAL ON A ROLL

BACKGROUND OF THE INVENTION

1. Field of the Invention

The present invention relates to a method and a device for the continuous casting of molten metal, particularly steel, on a roll.

2. Description of the Related Art

These prior art devices essentially comprise a roll with a horizontal axis rotating about its axis and equipped with powerful means for cooling its outer wall. This roll receives the molten metal from a container which comprises an inclined front wall, the free upper edge of which, via which the molten metal tends to be poured, is swept by the surface of the casting roll. This roll/container interaction takes place in a contiguous manner in order to avoid any leakage of molten metal between them.

The roll is thus supplied upstream of its upper generatrix relative to the direction of flow of the product. Due to the roughness and rotation of the roll, the molten metal is deposited on the latter and, through the effect of rotation, is entrained out of the bath in order to leave the roll when its cooling is sufficient. It is thus possible to obtain steel products whose thickness is less than 1 mm.

In fact, the solidified thickness of metal, when it leaves the roll, quite obviously depends on the duration of contact with the roll and on the efficiency of the cooling performed.

Because the molten metal is supplied upstream of the upper generatrix of the roll, the molten metal, which adheres to the cold wall of the roll, has firstly to rise up to this upper generatrix before coming back down slightly and leaving the surface of the roll. In some cases, it comes about that the roughness of the roll alone becomes insufficient to entrain the product at the start of the casting. In fact, at that moment, the lead angle, that is to say the angel at the center of the roll intersecting the arc located between the point at which the cast metal comes into contact with the roll and the horizontal, may be relatively small. The value of this angle, it will be understood, varies as the length of the arc of contact of the cast metal with the roll, which arc, for a given speed of rotation of the roll, determines a duration of contact and thus the thickness of the product.

SUMMARY OF THE INVENTION

The subject of the present invention is a method for continuous casting on a cooled roll rotating about its horizontal axis, which makes it possible to work with small lead angles even when the roughness of the roll is insufficient to initiate casting at these small lead angle values. The invention even makes it possible to work with negative lead angles.

The method according to the invention is particularly remarkable in that the start of continuous casting takes places with a large lead angle, greater than 45° and preferably even of the order of 60°, and in that, when casting has started, the container is displaced in order to reduce the lead angle.

In other words, the invention provides for casting to start with a large lead angle and for the latter to be gradually reduced when casting is well under way, that is to say when the free end of the cast product has passed beyond the upper generatrix of the roll.

When this start has taken place, it is then possible to lower the container along the roll in order to reach the optimum lead angle value. It is even possible to envisage working at negative lead angle values, that is to say placing the generatrix of first contact with the cast metal below the transverse horizontal plane of the roll.

A further subject of the invention is a device for continuous casting implementing the above-mentioned method.

This invention is particularly remarkable in that it comprises rotationally displacing the assembly consisting of the roll and the container about a horizontal axis such that the inclined front face of the container always remains contiguous with the roll in order to ensure leaktightness as regards the molten metal.

BRIEF DESCRIPTION OF THE DRAWINGS

The single drawing shows a cross section of the roll and container of this invention.

According to an embodiment of the invention, this assembly axis of rotation is the axis of the roll itself.

Other features and advantages of the invention will become apparent during the following description which is given with reference to the appended drawing which illustrates an embodiment thereof by way of non-limiting example.

DESCRIPTION OF THE INVENTION

The figure shows a roll 1 for continuous casting, which comprises inner means (not shown) for cooling its outer wall. This roll is driven in rotation in the direction of the arrow 2. It is fed with molten metal at its part which is located upstream of its upper generatrix 3 relative to the direction of rotation by means of a container 4 filled with molten metal. This container 4 is fed with molten metal by means of a nozzle (not shown) which is immersed in the molten metal whose free surface is referenced by 6. The molten metal leaves the container via the lowered upper edge 11 of the front wall 5 which is swept by the cooled surface of the casting roll, only a small operational play being provided at this point in order to prevent leakages of molten metal to take place due to gravity where the upper edge 11 meets the surfaces of the roll 1.

The layer 7 of molten metal which attaches itself to the roll firstly rises with the roll as the roll rotates in the direction of arrow 2 in order to pass beyond the upper generatix 3, while solidifying, layer 7 then continues coming back down with the roll 1 and leaves the latter when this layer is sufficiently solidified in order to produce a thin plate 8 of the metal.

If the roughness of the roll is insufficient, this layer 7 will not succeed in rising as far as the upper generatix 3 due to gravity which tends to oppose the attachment of the layer 7 to the roll.

According to the invention, starting of casting takes place with a sufficiently large lead angle A in order to ensure starting of the layer 7 even if the condition of the surface of the roll does not exhibit an outstanding roughness. For example, the layer 7 may be started with a lead angle A equal to 60°. Then, when the layer 7 formed has passed beyond the upper generatrix 3 and begins coming back down on the other side, there is a transistional phase during which the lead angle changes from the maximum starting lead angle to the normal operating lead angle B, of the order of 30°, which is determined, in particular, as a function of the length required for the arc of contact. In the example shown, the lead angle A at the start is 60° and the normal operating angle B is 30°, this angle being maintained throughout casting after the intermediate stage mentioned above.

When casting has started, the operating angle can be further reduced and even brought down to negative values, that is to say that the point of contact is located below the horizontal diameter of the roll 1. This is particularly advantageous in order to study the possibility of working with small or negative starting angles, even with a roll which has relatively little roughness.

In order to ensure leaktightness where the edge 11 joins roll, it is important to keep the angle of inclination $\alpha$ made by the front wall 5 with the surface of the roll 1 constant, and for this to apply regardless of the relative position of the container with respect to the roll. This is why the combined container 4 and the roll assembly forms a non-deformable entity in rotation about any horizontal axis, which may, moreover, be coincident with the axis X of the roll itself, as is the case in the figure. To this end, a flange 10 is provided, which rigidly connects the bottom of the container to a sleeve 12 mounted movably about the axis X beyond the roll 1. A motorised jack 13, fastened to the casting floor, adjusts the angular position of the container with the aid of its working rod, whose free end 14 is articulated at a point located at the periphery of the bottom of the container, opposite the front wall 5.

These means thus make it possible to displace the container 4 in rotation about the axis of the roll 1, between its starting position 4 and its nominal operating position 4'.

Of course, other alternative embodiments may be chosen, consisting particularly in choosing a pivoting axis which is different from the axis of rotation of the roll, so as to cause the cylinder 1/container 4 assembly to pivot in this case. Fastening means must then be provided in order to rigidly immobolize the container and the roll, as well as means for joining this assembly to the pivoting axis.

We claim:

1. A method for starting a continuous casting device for casting a molten metal comprising:

rotating a rotatable roll having a cooled cylindrical surface about a horizontal axis of said roll;

positioning a container adapted to hold the molten metal, adjacent to said roll, said container having: a front wall; and a free upper edge portion on the front wall;

said container being positioned so that the free upper edge portion of the front wall can be swept by the cooled cylindrical surface of the rotatable roll without said molten metal substantially leaking between the cylindrical surface of the rotatable roll and the free upper edge portion of said front wall;

starting the continuous casting of the continuous casting device by initially flowing the molten metal over said free upper edge portion of the front wall in a sufficient quantity to initiate starting of casting, said molten metal being in contact with and solidifying on said cooled cylindrical surface of said rotatable roll so that a first lead angle is formed at the center of the roll, said first lead angle being defined by a horizontal plane passing through the horizontal axis of the rotatable roll and a radius of said rotatable roll, said radius being positioned between the axis of said rotatable roll and a point on the cooled surface of the rotatable roll where the molten metal begins to at least partially solidify; and then reducing the first lead angle to a second lead angle after the start of the continuous casting, to enable subsequent continuous casting, said second lead angle being smaller than said first lead angle whereby the continuous casting can be initiated when the first lead angle is formed even if the second lead angle subsequently formed to provide continuous casting is too small to initiate the starting of the casting of the molten metal.

2. The method according to claim 1, wherein the first lead angle is greater than 45°.

3. The method of claim 2, wherein the second angle is substantially 3°.

4. The method of claim 1, wherein the roll and the container form a unitary assembly and wherein the container is displaceable to control said first and second lead angles by pivoting of the assembly about a horizontal axis of the assembly.

5. The method according to claim 4, wherein the axis about which the assembly is pivotable is coincident with the axis of rotation of the roll.

6. The method of claim 1, wherein the molten metal is steel.

7. A method for starting a continuous casting device for casting molten metal comprising:

rotating a roll, having a cooled cylindrical surface, about a horizontal axis of the roll;

providing a container adapted to hold the molten metal, said container including: a front wall, and a free upper edge portion on said front wall;

positioning the container adjacent to the cooled surface of the rotating roll so that the free upper edge portion of said front wall of said container can be swept by the cooled cylindrical rotating surface of said roll;

said cooled cylindrical surfaces of said roll and said free upper edge portion of said container when positioned adjacent each other, substantially preventing molten metal from leaking therebetween;

starting the continuous casting device by positioning the free upper edge portion of the front wall of the container at a casting starting position relative to said roll to cause sufficient molten metal in said container to flow over said free upper edge portion of said front wall onto said cooled rotating roll surface to initiate starting of casting of said molten metal;

then controllably lowering the free upper edge portion of the front wall of the container relative to said roll from the casting starting position to an operational position so that an adequate amount of molten metal in said container flows over said free upper edge portion of said front wall onto said cooled rotating roll surface to enable the continuous casting of said molten metal;

the free upper edge portion of the front wall of said container when at the casting starting position forming a first lead angle at the center of the roll, said first lead angle being defined by a horizontal plane which passes through the axis of the roll and a radius of the roll, said radius extending from the horizontal axis of said roll to a point positioned on said cooled surface of said roll where the molten metal begins to at least partially solidify;

the free upper edge portion of the front wall of said container when lowered to the operating position forming a second lead angle at the center of the roll, said second lead angle being defined by the horizontal plane which passes through the axis of the roll and another radius of the roll, the another radius extending from the horizontal axis of said roll to another point positioned on said cooled surface of said roll where the molten metal begins to at least partially solidify, the continuous casting being initiated when the free upper edge portion of the front wall of the container is at the casting starting positioned so that the first lead angle is formed even if the second lead angle subsequently formed at the operational position is too small to initiate the starting of the casting of the molten metal.

8. The method according to claim 7, wherein the first lead angle is greater than 45°.

9. The method according to claim 8, wherein the second lead angle is substantially 30° .

10. The method of claim 7, wherein the roll and the container form a unitary assembly and wherein the container is displaceable to control said first and second lead angles by pivoting the assembly about a horizontal axis of the assembly.

11. The method according to claim 10, wherein the axis about which the assembly is pivotable is coincident with the horizontal axis of rotation of the roll.

12. The method of claim 7, wherein the molten metal is steel.

* * * * *